US005504945A

United States Patent [19]

Purnell

[11] Patent Number: 5,504,945

[45] Date of Patent: Apr. 9, 1996

[54] PROTECTIVE EAR GUARD ASSEMBLY FOR WRESTLERS

[76] Inventor: John W. Purnell, 406 Lawrence Ave., West Lawn, Pa. 19609

[21] Appl. No.: 394,951

[22] Filed: Feb. 27, 1995

[51] Int. Cl.[6] ..... A63B 71/10

[52] U.S. Cl. ..... 2/425; 2/209

[58] Field of Search ..... 2/2, 9, 209, 410, 2/411, 412, 414, 421, 423, 425

[56] References Cited

U.S. PATENT DOCUMENTS

| | | | |
|---|---|---|---|
| 537,686 | 4/1895 | Johnson . | |
| 2,277,994 | 3/1942 | Roberts . | |
| 2,886,818 | 5/1959 | Roberts . | |
| 2,898,596 | 8/1959 | Keen . | |
| 3,311,921 | 4/1967 | Helm . | |
| 3,327,316 | 6/1967 | Pukish, Jr. . | |
| 3,513,482 | 5/1970 | Holden . | |
| 3,596,288 | 8/1971 | Marchello | 2/421 |
| 4,551,861 | 11/1985 | Marchello | 2/425 |
| 4,710,985 | 12/1987 | Dubner et al. | 2/425 |
| 4,821,345 | 4/1989 | Marchello | 2/425 |
| 5,228,143 | 7/1993 | Marchello | 2/425 |

*Primary Examiner*—Michael A. Neas
*Attorney, Agent, or Firm*—Sherman and Shalloway

[57] ABSTRACT

The present invention provides a protective ear guard assembly for covering and protecting portions of a user's head, particularly for wrestlers. The assembly includes a pair of ear guards each consisting of a resilient semi-rigid shell having a cup shaped center section and a peripheral outer flange, a plurality of strap attachments, an outer partially compressed foam pad corresponding to the shape and size of the shell and having a plurality of raised areas, an inner foam ring corresponding substantially to the outer flange of the shell and a molded flexible outer cover substantially covering the foam pads and having openings corresponding to the raised areas of the outer foam pad whereby those raised areas protrude through the outer skin cover. The assembly also includes a plurality of retention straps adjustably connectable to the strap attaching means and adapted to traverse the user's head enabling the headgear assembly to be held in position on the head; and accessory protective guards consisting of a forehead pad and auxiliary ear pads which are removably attachable to the ear guards and the retention straps.

19 Claims, 6 Drawing Sheets

PROTECTIVE EAR GUARD ASSEMBLY FOR WRESTLERS

FIELD OF THE INVENTION

This invention relates to a protective ear guard assembly and accessories therefor for use by wrestlers and other athletes who require protective covers for the ears and the forehead during practice and contests. The ear guards and accessories are assemblable to form a protective head piece which is worn by wrestlers and other athletes.

BACKGROUND OF THE INVENTION

Amateur wrestlers are subjected to maneuvers and contact with opponents and the wrestling mat which can result in injuries to the outer ear surfaces and to the forehead. Such injuries can be the result of unintentional blows to the ear by opponents, abrasion by sliding contact with the mat, i.e., mat burn, and unintentional head contact between opponents, i.e., head butts. As a means of protecting against such injuries, ear guard devices are in wide-spread use and generally provide a reinforced cup shaped protector covering the ears.

One currently popular ear guard is represented by U.S. Pat. No. 2,898,596, Keen, and includes an inner metal reinforcing plate surrounded by an energy absorbing cover which is formed by cutting sheet foam material to form a piece covering the outside of the plate and a ring shaped piece for the inside. These foam pieces are bonded together at their outer periphery and coated with plastic or rubber material by dipping to form a smooth coating over the outside. The coated foam cover forms a jacket which is placed over the metal plate. Cut out areas are provided in the jacket to allow head straps to be attached to the ear guards. A disadvantage to this construction is that it provides essentially only one level of protection through the compression of the single thickness of foam after which shock forces are transmitted directly to the user's head through the inflexible metal cup. In addition, this device affords little protection to the opposing athlete since his direct contact is with the substantially less resilient plastic or rubber outer covering which can result in abrasions or other injuries.

A simplified version of this ear guard is disclosed in U.S. Pat. No. 4,821,345, Marchello, wherein the molded outer skin is sufficiently resilient to enable it to deform to envelope a metal reinforcement plate. The improvement is directed to providing the cover with reinforced marginal areas around the head strap cut outs to provide strength and resistance to tearing of the cover when it is pulled on during adjustment of the head straps. In addition, the inner peripheral edge of the cover is ribbed where it engages the outer edge of the reinforcement plate to reduce the likelihood of cutting through the cover. There is no increase in protection and shock absorbancy in the ear guards of Marchello.

Similar types of ear guards which include an inner reinforcing plate with outer foam padding and head straps are shown in U.S. Pat. No. 537,686, Johnson, U.S. Pat. No. 2,277,994, Roberts, U.S. Pat. No. 2,886,818, Roberts, U.S. Pat. No. 3,311,921, Helm, U.S. Pat. No. 3,327,316, Pukish, Jr., and U.S. Pat. No. 3,513,482, Holden. In each of these patents, the level of shock absorbancy is substantially limited to a single thickness of foam and little or no consideration is given to protection against injury to the wearer's opponent in the event of the opponent's contact with the device.

SUMMARY OF THE INVENTION

The present invention is an improvement over the prior art and provides an ear guard construction which results in better protection to both the wearer and his opponent and which provides a multi-level degree of protection and shock absorbancy. In addition, the invention provides a protective ear guard assembly which includes accessories providing protection for the user's forehead and for an ear which has previously been injured and requires additional padding. Furthermore, the present invention provides a means which facilitates the receipt of strap ends within the ear guards thereby removing them from the field and from presenting a potential danger to the eyes of other wrestlers.

The present invention provides a protective ear guard assembly for covering and protecting portions of a user's head, the assembly comprising a pair of ear guards each comprising a resilient semi-rigid shell having a cup shaped center section and a peripheral outer flange, a plurality of strap attaching means, an outer pad of partially compressed energy absorbing foam corresponding to the shape and size of the shell and having a plurality of raised uncompressed areas, an inner ring of energy absorbing foam corresponding substantially to the outer flange of the shell and a molded flexible outer skin cover substantially covering the foam pads and having openings corresponding to the raised areas of the outer foam pad whereby those raised areas protrude through the outer skin cover. The assembly also includes a plurality of retention straps adjustably connectable to the strap attaching means and adapted to traverse the user's head enabling the ear guard assembly to be held in position on the head, and a plurality of accessory protective guards for areas of the head which are removably attachable to the ear guards and the retention straps.

The present invention further provides a protective ear guard assembly comprising a pair of left and right ear guards and a plurality of straps removably attachable to the ear guards and adapted to traverse a user's head. The ear guards comprise a substantially semi-rigid inner shell having a cupped center portion forming a concave inner surface and a convex outer surface, and a flat peripheral flange having strap attachment means spaced circumferentially therearound. The shell exhibits some resiliency enabling it to flex slightly in response to force exerted on the convex outer surface. An inner cushion pad of energy absorbing foam is provided against the inner surface of the flange and corresponding in size and shape to the flange. This inner pad has cut out areas at locations corresponding to the strap attachment means. An outer cushion pad is provided against the outer surface of the inner shell and corresponding in size and shape to the shell. The outer pad comprises a partially compressed energy absorbing foam having uncompressed areas separated by and extending above the compressed areas, wherein the compressed areas have a thickness of about one half that of the uncompressed areas, and cut out areas corresponding to the strap attachment means. Finally, the assembly includes a flexible molded outer skin cover having an inner flange adapted to fit over and cover the inner cushion pad and the flange, and an outer framework adapted to fit over the outer cushion pad and corresponding to the compressed areas of the outer cushion pad. The framework defines a plurality of apertures through which the uncompressed areas of the outer cushion pad protrude, the inner flange and outer framework being continuous at their outer peripheries. Like the foam pads, the outer skin has apertures corresponding to strap attaching means.

The present invention further provides a protective ear guard assembly which comprises left and right ear guards, a plurality of retention straps, a forehead pad and auxiliary ear pads all of which are adjustably combined to form the ear guard assembly. Each individual ear guard comprises an inner shell of molded plastic having a cupped center portion forming a concave inner surface and a convex outer surface, and a flat peripheral flange with a substantially straight forward edge and curved upper, lower and rear edges with strap attachment means spaced circumferentially thereabout. The shell is substantially semi-rigid and exhibits some resiliency enabling it to flex slightly in response to force exerted on the convex outer surface. An inner cushion pad of energy absorbing foam is provided against the inner surface of the flange and corresponds in size and shape to the flange, cut out areas are provided at locations corresponding to the strap attachment means. An outer cushion pad of partially compressed energy absorbing foam is placed against the outer surface of the inner shell and corresponds in size and shape to the shell. The outer pad has uncompressed areas separated by and extending above compressed areas, wherein the compressed areas have a thickness of about one half that of the uncompressed areas. As with the inner cushion pad, cut out areas are provided corresponding to the location of the strap attachment means. A flexible molded outer skin cover comprising an outer framework is adapted to fit over the outer cushion pad and corresponds to the compressed areas of the outer cushion pad. The framework defines a plurality of apertures through which the uncompressed areas of the outer cushion pad protrude. The outer framework is continuous at the outer periphery and includes an underskirt extending inwardly from the outer periphery over the inner shell flange and inner pad whereby the inner shell, the inner pad and the outer pad are confined by the outer skin and the outer skin has apertures corresponding to the strap attaching means.

The plurality of retention straps are adjustably attachable to the ear guards and are adapted to traverse a user's head whereby the left and right ear guards are held in place against the user's head. The retention straps are spaced around the rear periphery of the ear guards from a point adjacent to the upper end of the substantially straight forward edge to a point adjacent to the lower end of the forward edge. The straps have means cooperating with the strap attaching means of the ear guards and the ear guards have means to receive the ends of the straps.

The forehead cushion comprises a pad of energy absorbing foam having compressed and uncompressed areas and a modified triangular shape with means at the apexes for attachment to the ear guards and to at least one retention strap whereby the pad is positioned to traverse a user's forehead. The compressed areas correspond to the periphery of the pad and to horizontal and vertical lines across the face of the pad. The lines of compression provide the pad with greater flexibility for conforming to a user's forehead.

The auxiliary ear pads are removably attachable to the ear guards over the underskirt of the outer skin to be disposed between said ear guards and a user's head. Each auxiliary ear pad comprises a ring of energy absorbing foam having a central opening corresponding to the cupped center portion of the ear guard and including attachment means adapted to overlay the strap attachment means of the inner shell and cooperate therewith for removable attachment of the auxiliary ear pads.

Thus, it is an object of this invention to provide an improved ear guard.

It is a further object to provide improved ear guards and accessories which cooperate to form protective assemblies to be worn by wrestlers and other athletes.

It is a still further object of this invention to provide a protective ear guard assembly for wrestlers which includes an improved ear guard construction, an accessory forehead protector and auxiliary ear pads.

Further objects and advantages will become evident from the following drawings and descriptions.

DETAILED DESCRIPTION OF THE INVENTION

Figure 1:
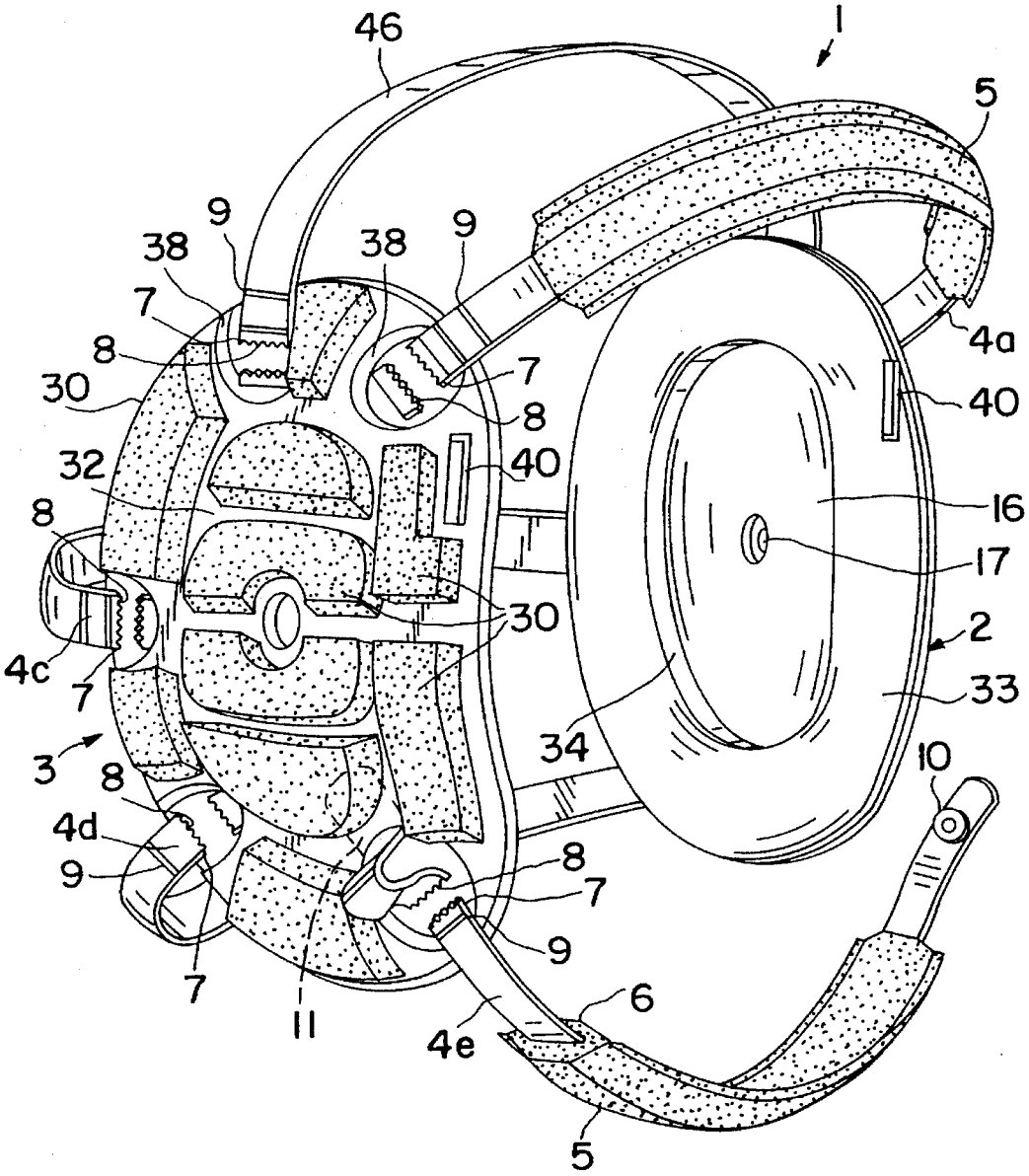
FIG. 1 is an oblique view of the protective ear guard assembly according to the present invention.

FIG. 1 illustrates the protective ear guard assembly 1 of the present invention showing the left and right ear guards 2, 3 joined together in wearable form by retention straps 4*a–e* to form a headpiece. Straps 4*a* and 4*e* are illustrated with optional foam coatings 5 which provide added padding to the straps where they cross the wearer's upper forehead and chin. Foam coatings 5 may be molded directly to straps 4*a* and 4*e* or they may be preformed with a longitudinal slot 6 and slid onto straps 4*a* and 4*e* when desired.

Straps 4*a–e* are preferably made from molded, flexible plastic and cooperate with attachment means for connecting to ear guards 2, 3. Preferably the attachment means provide adjustability to permit the assembly 1 to be sized to different individuals. A preferred attachment means comprises paired slots 7 spaced around the periphery of the ear guards 2, 3 through which the ends of straps 4*a–e* are passed. To lock straps 4*a–e* in place within slots 7, each of the pair of slots 7 is provided with a plurality of molded teeth 8 along the edge adjacent to the other slot of the pair. Straps 4*a–e* are provided with a plurality of parallel spaced ridges 9 which are perpendicular to the longitudinal axis of the straps. Ridges 9 extend upward from the outer surface of the straps and engage teeth 8 when the straps are woven through the paired slots 7 as shown in FIG. 1 thereby serving as detents to prevent the straps 4*a–e* from loosening. In order to permit the user to easily don and remove the assembly 1, one end of chin strap 4*e* is provided with a snap 10 or other releasable fastener, one of the ear guards 2 or 3 having a corresponding part of such fastener mounted thereon in place of the paired slots 7 in the comparable position on the other ear guard. Other attachment means, such as snaps or the like, may be used in place of the paired slots 7; however, the slots are preferred to avoid inadvertent separation during use.

A safety feature of the assembly 1 is partially shown in FIG. 1. With previous headgear of this type it has been usual for the ends of retention straps to be allowed to hang free. This presents a hazard to the eyes of a wrestler's opponent.

Assembly 1 of the present invention provides means facilitating the insertion of strap ends 11 under the protective padding of the ear guards 2, 3. The nature of this feature will become more evident from FIGS. 2 and 3 and the description thereof which follows.

Figure 2:
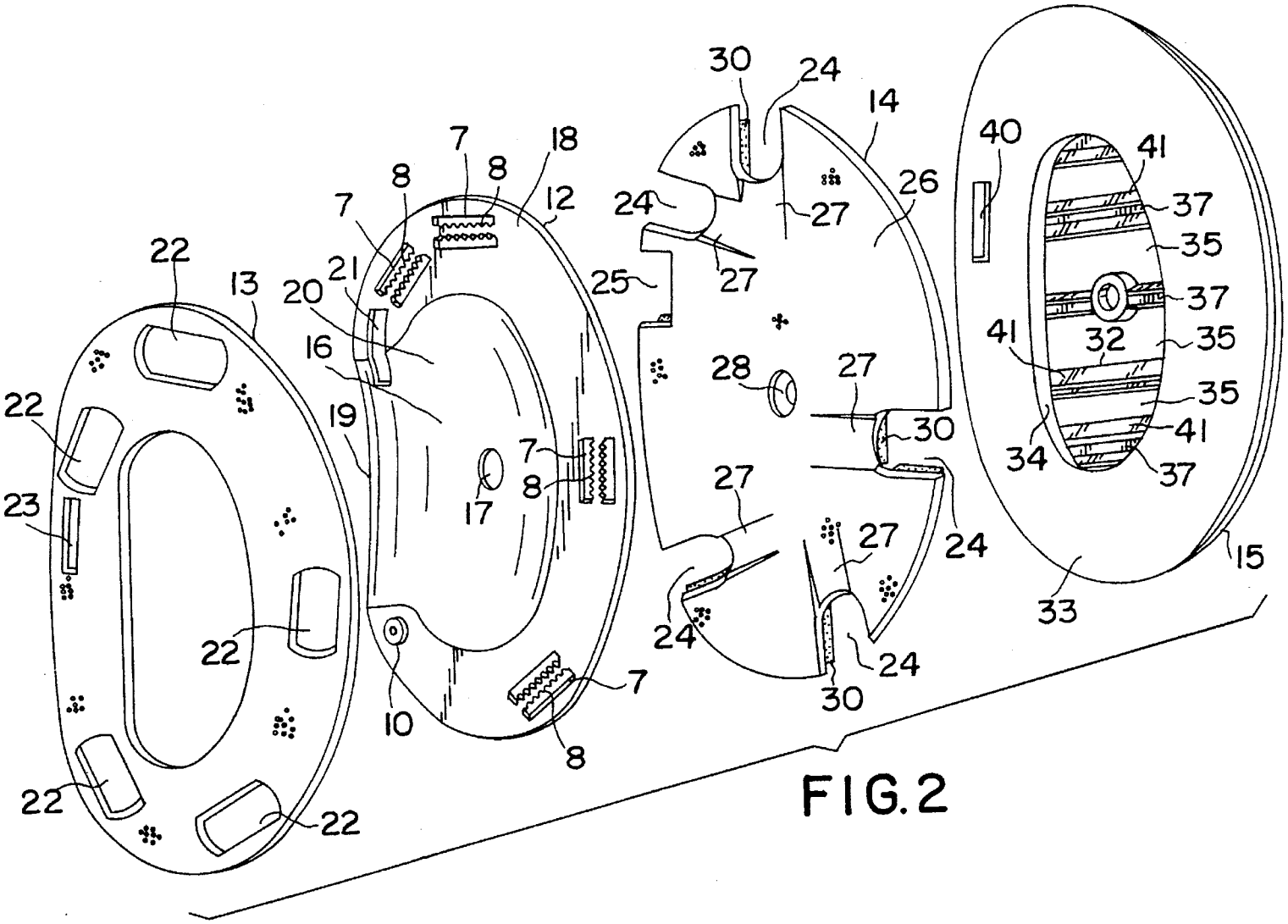
FIG. 2. is an exploded view of the ear guard of the present invention.

FIG. 2 illustrates left ear guard 2 of FIG. 1. Right ear guard 3 is substantially identical except for the substitution of an additional pair of parallel slots 7 in place of the snap half 10 shown here. Ear guards 2, 3 are constructed from four parts; an inner semi-rigid shell 12, an inner foam pad 13, an outer foam pad 14 and an outer flexible molded cover 15.

Semi-rigid shell 12 is molded from a plastic material and comprises a cup shaped center section 16 having a concave inner surface and a convex outer surface. Cup 16 is sized to comfortably receive the user's outer ear. Substantially centrally located in the cup 16 is at least one aperture 17 which serves to permit the equalization of air pressure over and within the user's ear when the assembly 1 is worn. Although illustrated with only one such aperture 17, ear guards 2, 3 may be constructed with more than one aperture 17 without departing from the spirit of this invention. Around the outer periphery of cup 16 is a flat flange 18 in which paired slots 7 with teeth 8 are located. Preferably flange 18 does not completely encircle cup 16 inasmuch as the forward edge 19 of ear guard 2, 3 is preferably molded to provide a passage 20 into cup 16 to facilitate hearing while the assembly is worn. In addition, forward edge 19 is preferably substantially straight in a vertical direction whereas the rest of the periphery of inner shell 12 is curved. Also located in flange 18 and extending downward into passage 20 is accessory slot 21, the purpose of which will be described later.

As noted previously, the material from which inner shell 12 is molded is preferably a plastic having sufficient rigidity at a minimum thickness to maintain its shape under stress but with a degree of resiliency which allows shell 12 to flex to a certain degree when struck. In this manner, inner shell 12 is able to absorb forces and shocks which may be applied to ear guards 2, 3 and which are greater than those absorbed by inner and outer foam pads 13 and 14. Examples of suitable plastic materials from which inner shell 12 may be molded include polyethylene, polystyrene, polyurethane, and the like.

Inner foam pad 13 is a ring having an outer dimension substantially equal to the outer dimension of inner shell 12 and an inner dimension substantially equal to the circumference of cup 16. The material of inner foam pad 13 is preferably EVA foam which is cut to shape and may be partially compressed, although pad 13 may also be provided in the uncompressed state as well as being formed from other foams having open or closed cells. In addition to a central aperture over cup 16, inner pad 13 is provided with apertures 22 at locations corresponding to paired parallel slots 7 which permit straps **4*a–e* to be more easily inserted into paired slots 7. Furthermore, an aperture 23 corresponding to accessory slot 21 is provided in the forward portion of inner pad 13**.

Outer foam pad 14 has a dimension substantially equal to that of the outer surface of inner shell 12 and includes cut out areas 24 in its periphery corresponding to the locations of paired parallel slots 7 and snap 10. An additional cut out 25 corresponds to the location of accessory slot 21. At least one aperture 28 is centrally located and corresponds to the position of aperture 17.

As shown in FIG. 2, the underside 26 of outer pad 14 is provided with channels 27 molded or otherwise formed in the surface 26 of pad 14. Channels 27 extend radially inward from the inner edges of cut out areas 24 such that when pad 14 is placed against the outer surface of inner shell 12, space is provided in which the ends 11 of straps **4*a–e* are received. In addition, outer pad 14 may be substantially planar or it may be molded to conform in varying degrees to the outer surface of inner shell 12**.

Figure 3:
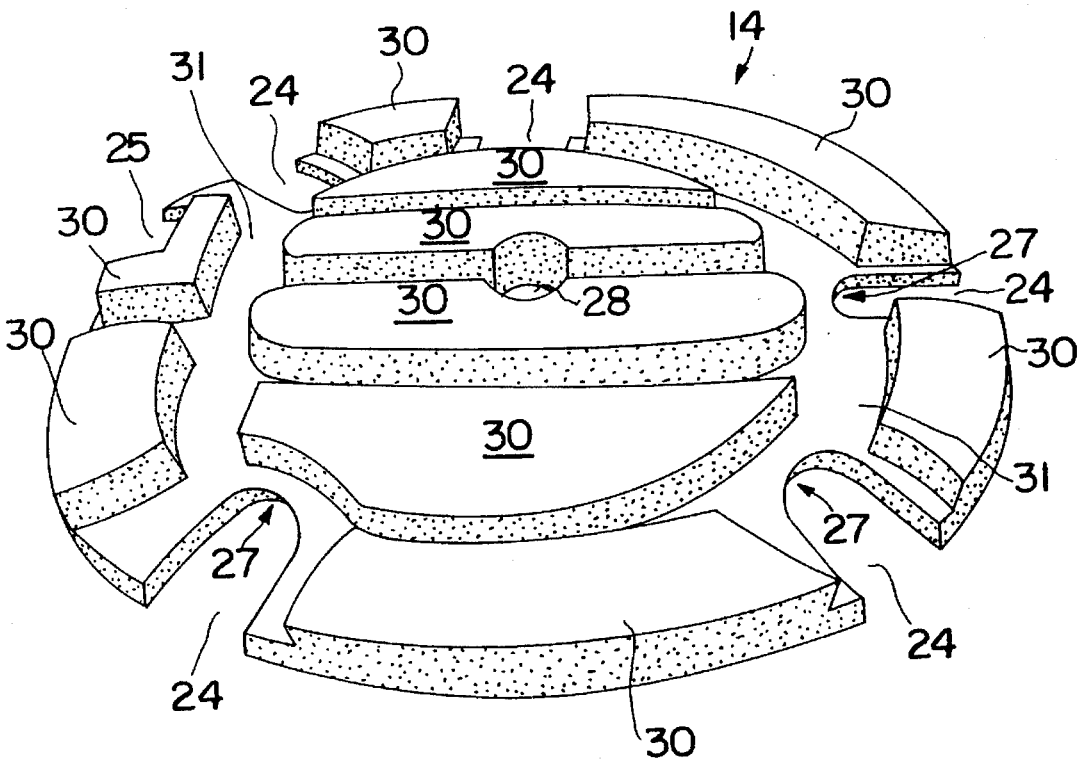
FIG. 3 is an oblique view of an outer foam pad of the ear guard of the present invention FIG. 4. is a plan view of the outer cover framework of the ear guard of the present invention.

Turning to FIG. 3, the upper surface 29 of outer pad 14 is seen. Like inner foam pad 13, outer pad 14 is preferably formed from EVA foam. However, whereas inner pad 13 is provided in a single thickness, outer pad 14 is molded to include a plurality of raised areas 30 surrounded by compressed areas 31. Preferably, the raised areas 30 constitute greater than 50% of the area of outer pad 14 with the compressed areas being less than 50% of the area. Most preferably, the relationship is about 75% raised and about 25% compressed. The compressed areas 31 are preferably about one half the thickness of the raised areas of foam which preferably has an overall thickness of about one half (½) to about three quarters (¾) of an inch with each raised area 30 being substantially surrounded by compressed area 31. The compressed areas 31 preferably have a thickness of about one quarter (¼) to about one half (½) of an inch. Furthermore, at least the upper surfaces of the raised areas 30 of foam are provided with a sealed smooth surface or skin. The structure of the outer foam pad 14 may be produced in any way suitable for molding foam. For example, a block of uncompressed foam may be molded between molded between two dies to compress the foam in areas and a pattern corresponding to the compressed areas 31 of pad 14. Alternatively, the foam precursors may be introduced into a closed mold having the shape of the pad to be produced whereupon expansion of the foam fills the mold and cures to form pad 14. Preferably pads 13 and 14 are formed with a smooth skin providing sealed, smooth surfaces. They may also be encased in a thin, lightweight woven or non-woven fabric, such as a tricot, applied during or after molding.

Outer cover 15 is molded from a flexible plastic material, such as vinyl or the like, and has an outer framework 32 which fits over the outer foam pad 14 and an underskirt 33 which extends radially inwardly from the periphery of the outer cover 15 over the inner foam pad 13. The effect is of a jacket which encloses the inner shell 12, inner pad 13 and compressed areas 31 of outer pad 14. For added comfort, the inner edge of underskirt 33 is provided with a skirt 34 which extends inwardly into cup 16.

Figure 4:
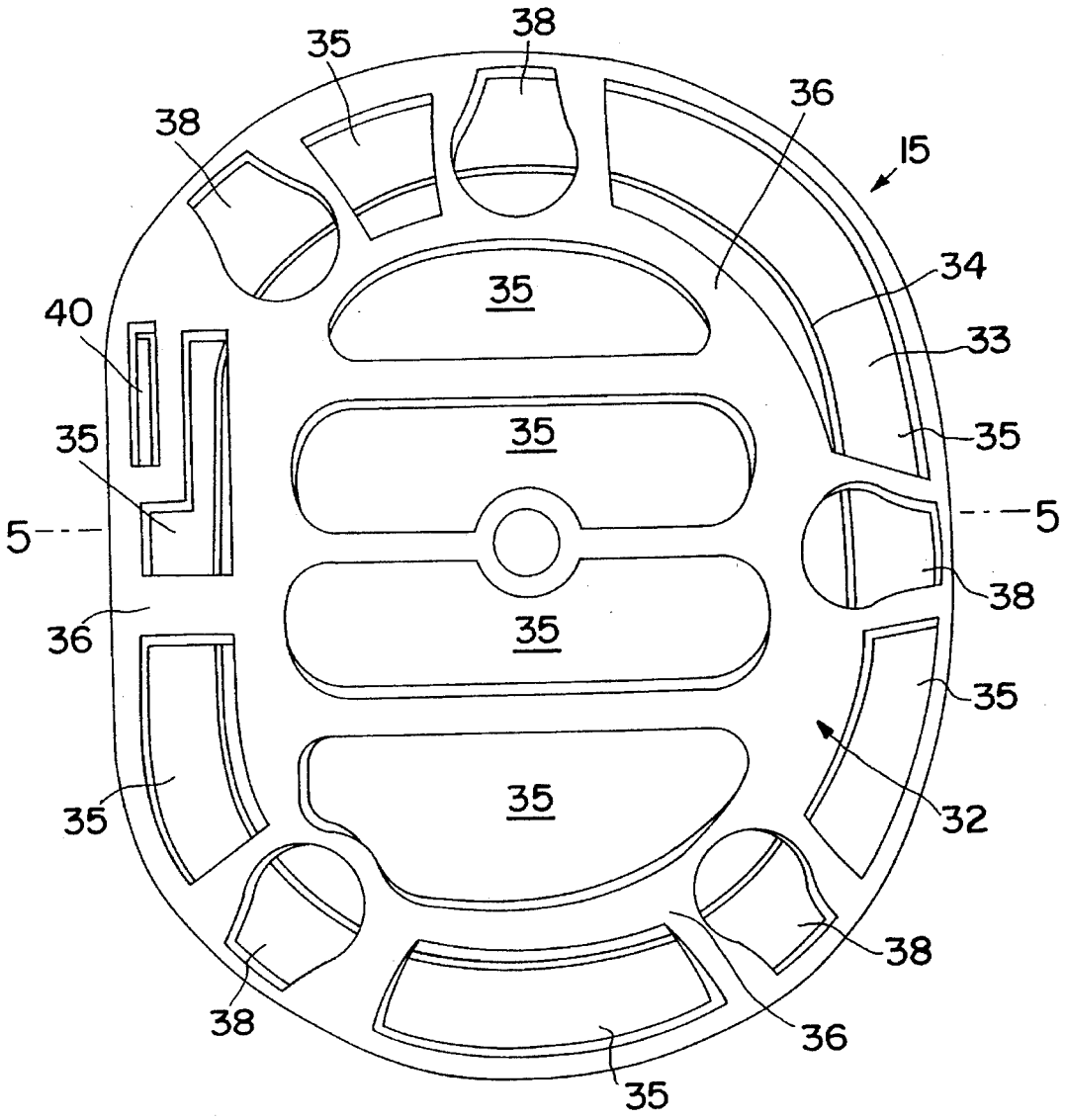
Figure 5:
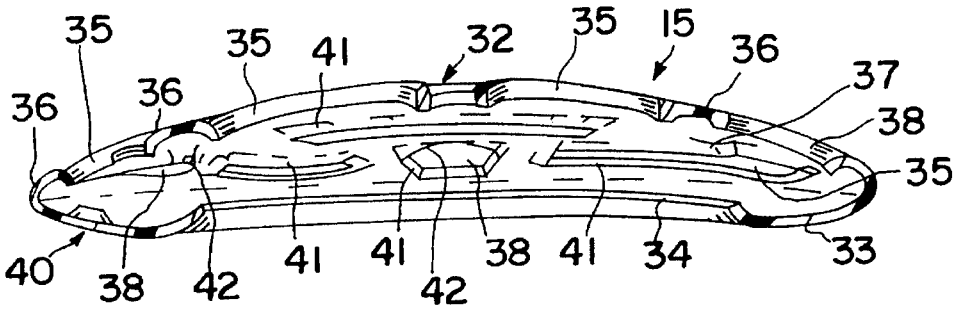
FIG. 5 is a cross section taken along line 5—5 of FIG. 4.

As shown in FIG. 1, the raised areas 30 of outer pad 14 are exposed on the outer faces of ear guards 2, 3 through framework 32 of outer cover 15. The raised areas 30 preferably extend beyond the outer cover 15 a distance of about one quarter (¼) to about one half (½) of an inch. This framework 32 of outer cover 15 is illustrated in FIGS. 4 and 5 and includes a plurality of apertures 35 corresponding in size, shape and location to the raised areas 30 of outer pad 14. Webbing 36 of framework 32 overlays the compressed areas 31 of outer pad 14 which may be adhered to inner surface 37 of webbing 36. In addition to foam apertures 35, outer cover has strap apertures 38 in locations corresponding to the locations of paired slots 7. Strap apertures 38 permit access to slots 7 and snap 10 for fastening of straps **4*a–e* to ear guards 2, 3. Furthermore, accessory apertures 40 are provided in outer cover 15 corresponding to the location of accessory slot 21**.

Although it is not a requirement, all apertures 34, 38 and 40 in outer cover 15, may by provided with peripheral skirts 41 extending inwardly similar to skirt 34 on underskirt 33.

Where skirts 41 are present around strap apertures 38, notches 42 will be provided lining up with channels 27 thus providing passage for the strap ends 11 into channels 27.

Applicant has found that the above-described construction for ear guards provides a greater degree of protection to users and opponents and greater absorbance of shock than is achieved with the prior art constructions where the foam pads are of a single thickness and completely encased within an outer cover. The structure of Applicant's outer foam pad 14 wherein the raised areas 30 of the foam extend beyond the outer cover 15 and are exposed to direct contact before the rest of the ear guard results in a two level rate of absorption of shock. When in use, the first contact with the ear guards is on the exposed uncompressed foam which compresses to absorb any force applied thereto without transmitting that force to the user. As these areas are compressed to the level of the outer cover 15 and the compressed areas 31, the rest of the outer foam pad begins to absorb the forces being applied thereto. In addition, some of the excess force being applied to the now compressed raised areas 30 is directed laterally into the body of foam pad 14 by the shape of cup 16 to be finally transferred to inner foam pad 13 which surrounds the wearer's ear. Furthermore, the exposure of the softer and more compliant foam as the first surface of contact affords greater protection to the wearer's opponents than a less yielding material such as the continuous vinyl cover of prior ear guards.

In the event a sudden shock is applied to the outer surface of ear guards 2, 3, not only is a portion of that shock absorbed and redirected by the structure of the foam pads 14 and 13, but, where the force of the shock is sufficient, inner shell 12 flexes and thus absorbs and diverts the shock radially outward. In this manner less of the shock and associated pressure is transmitted to the user's ears.

Figure 6:
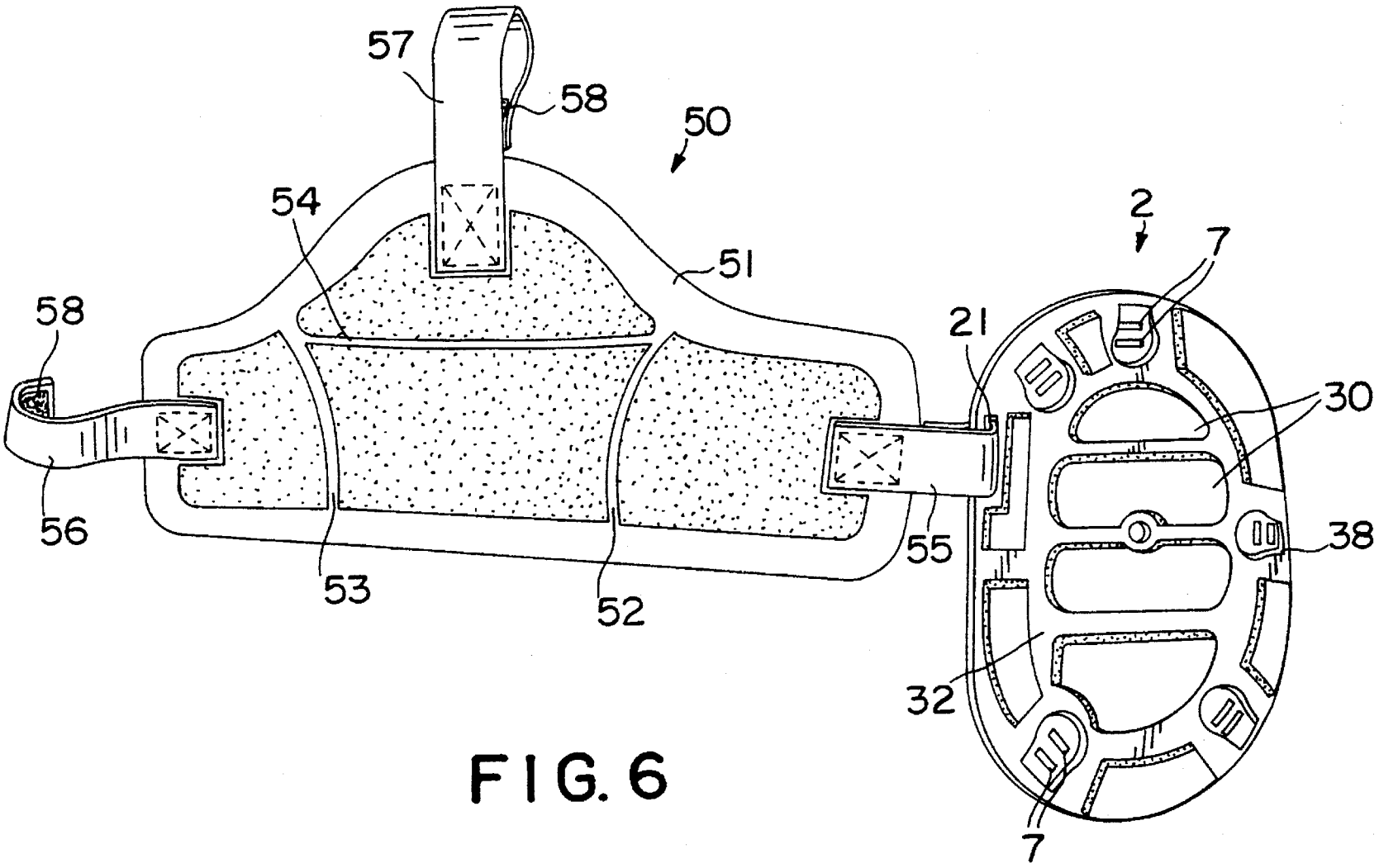
FIG. 6 is a semi-oblique view of the forehead pad of the assembly of the present invention shown attached to one ear guard.

Turning now to the accessories which are provided as part of the assembly of the present invention, FIG. 6 shows a forehead pad 50 which attaches to the ear guards 2, 3 and to the upper forehead retention strap 4*a*. Forehead pad 50 is molded from a substantially triangular or three lobed piece of foam which is preferably compressed around the periphery 51 and along three lines 52, 53 and 54 as shown. These lines of compression provide lines of greater flexibility to the foam pad 50 enabling it to better conform to the shape of the user's forehead. Although pad 50 may be left uncoated, it is preferred that a protective layer of either curable material, such as vinyl, or a fabric be applied over the foam thereby encasing the forehead pad 50. Where the protective layer is a fabric, it may be a fabric such as a tricot knit which is bonded to the foam at the time it is molded. Alternatively, the fabric may be a cotton or other woven or non-woven material which is bonded or sewn to the foam pad 50. When a curable coating is used, it to may be applied at the time the foam is molded or it may be applied later by spraying or dipping. As with pads 13 and 14 of the ear guards 2 and 3, forehead pad 50 is preferably molded from an energy absorbing foam such as open or closed cell EVA foam. Other foams may also be used and similar methods of manufacture, i.e., compression molding, expansion molding, etc., may be used for fabrication.

Attachment of pad 50 to the ear guard assembly 1 is preferably by means of straps 55, 56 and 57 provided at the three apices of the substantially triangular shape of the pad. FIG. 6 illustrates the placement of these straps and shows the forehead pad 50 attached to left ear guard 2 by means of strap 55 which is looped through accessory slot 21 and then attached to itself. Any form of self attachment may be employed including mechanical fasteners. However, it is preferred to use a simple hook and pile fastener 58 applied to the back side of the straps 55, 56 and 57. Strap 56 attaches the other end of pad 50 to right ear guard 3 in the same manner by being looped through accessory slot 21 therein and strap 57 is looped around upper forehead retention strap 4*a* of the assembly 1. This method of attachment permits the forehead pad 50 to be quickly and easily attached to or removed from the assembly 1 and does not interfere with adjustment of the assembly 1 to different sized users.

Figure 7:
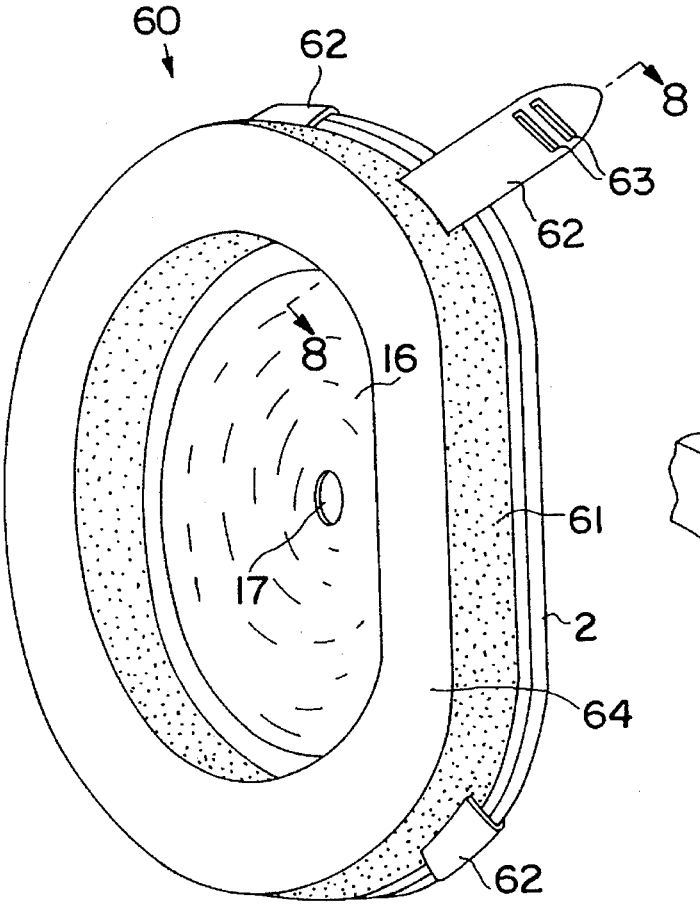
FIG. 7 is an oblique view of the auxiliary ear pad of the present invention.
Figure 8:
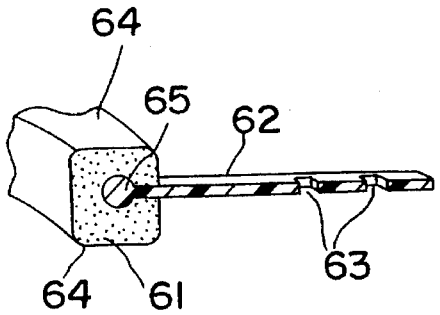
FIG. 8 is a partial cross-section of the auxiliary ear pad taken along line 8—8 of FIG. 7.

The second accessory for use with the ear guard assembly of the present invention is an auxiliary ear pad 60 for use by individuals who have suffered an injury, such as "cauliflower ear", or by those who require additional padding between the ear guards 2 and 3 and their ears. Shown in FIG. 7, the auxiliary ear pad 60 consists of an additional ring 61 of compressed or uncompressed foam having dimensions substantially equal to those of inner foam pad 13 of the ear guards 2 and 3. As with forehead pad 50, ring 61 may be provided as uncoated foam, although preferably with smooth and sealed surfaces, or it may be coated in the manner discussed above. Ring 61 is provided with a means for attachment to the ear guards 2, 3 which cooperates with the paired slots 7 and retention straps 4*a–e* of the headgear. The ring attachment means consists of a plurality of strap members 62 spaced around the ring 61 at locations corresponding to those of the paired slots 7 of the ear guards 2 and 3. As shown in FIG. 8, strap members 62 are preferably molded into foam ring 61 and extend laterally therefrom at a point substantially equidistant in the thickness of ring 61 between the parallel faces 64, thus permitting ring 61 to be reversible for mounting on either left or right ear guards 2 and 3. Inner ends of strap members 62 preferably have an anchor means to resisit pulling out of foam ring 61. Such anchor means may take the form of an enlargement as shown in FIG. 8 or apertures in the strap member through which the foam extends to lock the strap member in place. In a still further embodiment, the strap members 62 may be an integral part of the ring 61 formed by extensive compression of laterally extending sections of the foam ring material. This embodiment is particularly suited to use with disposable auxiliary pads. The ends of the strap members 62 are provided with paired parallel slots 63 having a relationship which corresponds to that of slots 7 in ear guards 2 and 3.

To attach the ring 61 to an ear guard 2 or 3, the ring 61 is placed on the inside of the ear guard 2, 3 against the exposed surface of underskirt 33. Strap members 62 are wrapped around the periphery of the ear guard and the slots 63 therein lined up with the paired slots 7 of the ear guard. The tips 64 of strap members 62 may be tucked into channels 27 through strap apertures 38. With the slots 63 and 7 aligned, retention straps 4*a–e* are then woven through both sets of slots, thereby securing the auxiliary ear pad to the ear guard. In the case of the ear guard having a snap half thereon for the releasable end of chin strap 4*e*, the corresponding strap member 62 of auxiliary ear pad 60 is preferably provided with appropriate snap halves on both sides instead of the parallel slots. In this case, the strap member 62 will be snapped over the snap half on the ear guard and will carry another snap half for attachment of chin strap 4*e* thereto. Alternatively, the strap member may be provided with a hole of sufficient size to allow passage of the ear guard snap half for connection to the snap half 10 on the end of chin strap 4*e* thereby securing the strap member between the ear guard and the end chin strap 4*e*.

The protective ear guard assembly of the present invention is preferably provided as a complete set which includes the left and right ear guards, retention straps, the forehead pad and at least one reversible auxiliary ear pad.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A protective assembly for covering and protecting a user's outer ears, the assembly comprising:

a pair of ear guards each comprising a resilient semi-rigid shell having a cup shaped center section and a peripheral outer flange, a plurality of strap attaching means, an outer partially compressed foam pad corresponding to the shape and size of said shell and having a plurality of raised uncompressed areas, an inner foam ring corresponding substantially to the outer flange of said shell and a molded flexible outer cover substantially covering said foam pads and having openings corresponding to said raised areas of said outer foam pad whereby said raised areas protrude through said outer cover;

a plurality of retention straps adjustably connectable to said strap attaching means and adapted to traverse a user's head enabling said headgear assembly to be held in position on the head; and a plurality of accessory protective guards for areas of the head and which are removably attachable to said ear guards and said retention straps.

2. The protective assembly of claim 1 wherein said strap attaching means comprise a plurality of paired parallel slots spaced around said outer flange, each slot having a plurality of teeth along the edge adjacent to the other slot of the pair.

3. The protective assembly of claim 2 wherein said plurality of retention straps are provided with parallel spaced ridges perpendicular to the longitudinal axis and on one side of each of said straps whereby said ridges engage said teeth when said straps are inserted through said slots thereby providing a locking means for said straps.

4. The protective assembly of claim 1 wherein said outer foam pad has cut out areas overlying said strap attaching means and channels molded into the surface of said pad opposite said raised areas and extending substantially radially inward from said cut out areas whereby ends of said straps are receivable therein between said pad and said shell.

5. The protective assembly of claim 4 wherein said accessories comprise a substantially rectangular foam pad adapted to traverse a user's forehead and having means for removable attachment to said ear guards and at least one of said retention straps.

6. The protective assembly of claim 5 wherein said means for removable attachment of said substantially rectangular pad comprise strap members attached to said pad at the longitudinal ends and midway along one long edge, said strap members having a releasable self attachment means on one side, and wherein said ear guards each have a slot in said peripheral flange, said slot being located adjacent a strap attachment means positioned to receive a retention strap adapted to traverse a user's upper forehead, whereby each of said strap members at the longitudinal ends of said pad is passed through a slot and attached to itself and said strap member located midway along said pad is looped around the upper forehead retention strap and attached to itself, whereby said substantially rectangular pad is positioned to traverse and protect the user's forehead when said headgear is worn.

7. The protective assembly of claim 1 wherein said accessories comprise at least one foam ring removably attachable to the inner surface of said ear guards, said ring corresponding substantially to the shape of said flange and having strap members spaced peripherally thereabout and extending radially therefrom at locations corresponding to said strap attaching means, said strap members having means to cooperate with said retention straps and said strap attaching means whereby said foam ring is removably attachable to the inner surface of each of said ear guards to be disposed between said ear guards and a user's head.

8. The protective assembly of claim 7 wherein said strap attaching means comprise a plurality of paired parallel slots spaced around said outer flange and said means on said strap members to cooperate with said strap attaching means and said retention straps comprise paired parallel slots in said strap members corresponding to said paired parallel slots of said outer flange, whereby slots of said strap members and of said strap attaching means are aligned and said retention straps are passed therethrough to attach said foam ring to said ear guards.

9. A protective assembly for athletes comprising a pair of ear guards and a plurality of straps removably attachable to said ear guards and adapted to traverse a user's head wherein said ear guards comprise;

a substantially semi-rigid inner shell having a cupped center portion forming a concave inner surface and a convex outer surface, and a flat peripheral flange having strap attachment means spaced circumferentially therearound, said shell exhibiting some resiliency enabling it to flex slightly in response to force exerted on said convex outer surface;

an inner cushion pad against the inner surface of said flange and corresponding in size and shape to said flange, said inner pad having cut out areas at locations corresponding to said strap attachment means;

an outer cushion pad against the outer surface of said inner shell and corresponding in size and shape to the shell, said outer pad comprising a partially compressed foam having raised areas separated by and extending above compressed areas, wherein the compressed areas have a thickness of about one half that of the raised areas, and having cut out areas corresponding to said strap attachment means; and a flexible molded outer skin cover having an inner flange adapted to fit over and cover the inner cushion pad and said peripheral flange, and an outer framework adapted to fit over said outer cushion pad and corresponding to the compressed areas of said outer cushion pad, said framework defining a plurality of apertures through which said raised areas of said outer cushion pad protrude, said inner flange and said outer framework being continuous at their outer peripheries whereby said inner shell, said inner pad and said outer pad are confined by said outer skin and said outer skin has apertures corresponding to the locations of said strap attaching means.

10. The protective assembly of claim 9 further comprising a forehead cushion comprising a foam pad having a modified triangular shape with means at the apexes for attachment to said ear guards and at least one strap whereby said pad is positioned to traverse a user's forehead.

11. The protective assembly of claim 10 wherein said forehead cushion comprises a foam pad having compressed and raised areas, said compressed areas corresponding to the periphery of said pad and to horizontal and vertical lines across the face of said pad, said lines of compression providing said pad with greater flexibility for conforming to a user's forehead.

12. The protective assembly of claim 9 further comprising an auxiliary ear pad removably attachable to said ear guard over the inner flange of said outer skin to be disposed between said ear guard and a user's head, said auxiliary ear pad comprising a ring of uncompressed foam having a central opening corresponding to the cupped center portion of said ear guard, said auxiliary ear pad further comprising attachment means adapted to overlay said strap attachment means of said inner shell and cooperate therewith for removable attachment of said auxiliary ear pad.

13. A protective headpiece comprising;

left and right ear guards, each ear guard comprising an inner shell of molded plastic having a cupped center portion forming a concave inner surface and a convex outer surface, and a flat peripheral flange with a substantially straight forward edge and curved upper, lower and rear edges and having strap attachment means spaced circumferentially therearound, said shell being substantially semi-rigid while exhibiting some resiliency thereby enabling it to flex slightly in response to force exerted on said convex outer surface; an inner cushion pad against the inner surface of said flange and corresponding in size and shape to said flange, said inner pad having cut out areas at locations corresponding to said strap attachment means; an outer cushion pad of partially compressed foam against the outer surface of said inner shell and corresponding in size and shape to the shell, said outer pad having raised areas separated by and extending above compressed areas, wherein the compressed areas have a thickness of about one half that of the raised areas, and having cut out areas corresponding to said strap attachment means; and a flexible molded outer skin cover comprising an outer framework adapted to fit over said outer cushion pad and corresponding to the compressed areas of said outer cushion pad, said framework defining a plurality of apertures through which said raised areas of said outer cushion pad protrude, said outer framework being continuous at the outer periphery and including an underskirt extending inwardly from the outer periphery over the inner shell flange and inner pad whereby said inner shell, said inner pad and said outer pad are confined by said outer skin and said outer skin has apertures corresponding to said strap attaching means;

a plurality of retention straps adjustably attachable to said ear guards and adapted to traverse a user's head whereby said ear guards are held in place against the user's head, said retention straps being spaced around the rear periphery of said ear guards from a point adjacent to the upper end of said substantially straight forward edge to a point adjacent to the lower end of said forward edge, said straps having means cooperating with said strap attaching means of said ear guards and said ear guards having means to receive the ends of said straps;

a forehead cushion comprising a foam pad having compressed and raised areas and a modified triangular shape with means at the apexes for attachment to said ear guards and to at least one retention strap whereby said pad is positioned to traverse a user's forehead, said compressed areas corresponding to the periphery of said pad and to horizontal and vertical lines across the face of said pad, said lines of compression providing said pad with greater flexibility for conforming to a user's forehead; and auxiliary ear pads removably attachable to said ear guards over the underskirt of said outer skin to be disposed between said ear guards and a user's head, said auxiliary ear pads each comprising a ring of uncompressed foam having a central opening corresponding to the cupped center portion of said ear guard, said auxiliary ear pads further comprising attachment means adapted to overlay said strap attachment means of said inner shell and cooperate therewith for removable attachment of said auxiliary ear pads.

14. The protective headpiece of claim 13 wherein said foam pads comprise molded EVA foam.

15. The protective headpiece of claim 14 wherein said means to receive the ends of said straps comprises channels molded in the underside of said outer pad adjacent to and extending inwardly from said cut out areas and wherein said apertures in said outer skin corresponding to said strap attaching means include means cooperating with said channels to receive the ends of said straps.

16. The protective headpiece of claim 15 wherein said strap attaching means comprise a plurality of paired parallel slots spaced around said outer flange, each slot having a plurality of teeth along the edge adjacent to the other slot of the pair.

17. The protective headpiece of claim 16 wherein said means to cooperate with said strap attaching means comprise a plurality of parallel spaced ridges perpendicular to the longitudinal axis and on one side of each of said straps whereby said ridges engage said teeth when said straps are inserted through said slots thereby providing a locking means for said straps.

18. The protective headpiece of claim 17 wherein the auxiliary ear pad attachment means comprise strap members spaced peripherally thereabout and extending radially therefrom at locations corresponding to said strap attaching means of said ear guards, wherein said strap members have paired parallel slots therein corresponding to said paired parallel slots of said ear guard strap attaching means, whereby slots of said strap members and of said strap attaching means are aligned and said retention straps are passed therethrough to attach said auxiliary ear pads to said ear guards.

19. The protective headpiece of claim 18 wherein said the auxiliary ear pads are reversible.

* * * * *